United States Patent [19]

Noguera

[11] 3,938,312

[45] Feb. 17, 1976

[54] YARN SPINNING APPARATUS

[76] Inventor: John Michael Noguera, 1 Greville House, Kinnerton St., London S.W. 1, England

[22] Filed: Sept. 20, 1974

[21] Appl. No.: 507,985

[30] Foreign Application Priority Data

Sept. 21, 1973 United Kingdom ..... 44502/73

[52] U.S. Cl. ..... 57/103; 57/58.89; 57/92

[51] Int. Cl.[2]... D01H 1/12; D01H 1/20; D01H 1/24

[58] Field of Search..... 57/58.89, 58.91, 58.93, 57/58.95, 102, 103, 92

[56] References Cited

UNITED STATES PATENTS

| | | | |
|---|---|---|---|
| 3,662,532 | 5/1972 | Stahlecker | 57/58.89 |
| 3,779,620 | 12/1973 | Stahlecker | 57/104 X |
| 3,793,820 | 2/1974 | Rajnoha et al. | 57/58.89 |
| 3,805,506 | 4/1974 | Stahlecker | 57/58.89 X |
| 3,807,157 | 4/1974 | Stahlecker | 57/58.89 |

*Primary Examiner*—John Petrakes

*Attorney, Agent, or Firm*—Haseltine, Lake & Waters

[57] ABSTRACT

An open end yarn spinning apparatus wherein the member that includes the collecting surface that, in operation, is rotated while having deposited on it fibers to be spun into yarn includes a shaft which is rotationally supported by shaft-mounted rollers of substantially greater diameter than the diameter of the part of the collecting surface shaft engaged thereby, and wherein an opening roller is mounted on a shaft of one of said shaft-mounted rollers to rotate therewith.

1 Claim, 11 Drawing Figures

YARN SPINNING APPARATUS

This invention relates to apparatus for spinning yarn by the open end spinning process, that is the process in which twisted yarn is formed by continuously depositing discrete fibers onto the rotating end of a yarn. In one of the most common methods of open end spinning, fibers are deposited onto a rotating collecting surface around which the loose end of a yarn is made to pass. As the yarn is withdrawn from the collecting surface it takes with it the fibers which have been deposited thereon and the rotation of the collecting surface imparts the necessary twists to form the yarn. The collecting surface can be the inner surface of a spinning chamber, the yarn being continuously withdrawn from the top or bottom of the chamber by the tail end of the yarn. Desirably the collecting surface rotates at very high speeds, in the region of 100,000 r.p.m.

Commonly used for depositing the fibers onto the collecting surface is an opening roller which rotates, in operation of the apparatus, at a fairly high speed of the order of 5,000 to 10,000 r.p.m. In operation this opening roller acts on a sliver (a fixed strand of textile fiber) fed thereto to separate out individual fibers and eject them at high speeds towards the collecting surface.

According to the present invention there is provided an open end yarn spinning apparatus, wherein the member that includes the collecting surface that, in operation, is rotated while having deposited on it fibers to be spun into yarn includes a shaft which is rotationally supported by shaft-mounted rollers of substantially greater diameter than the diameter of the part of the collecting surface shaft engaged thereby, and wherein an opening roller is mounted on a shaft of one of said shaft-mounted rollers to rotate therewith.

Figure 1:
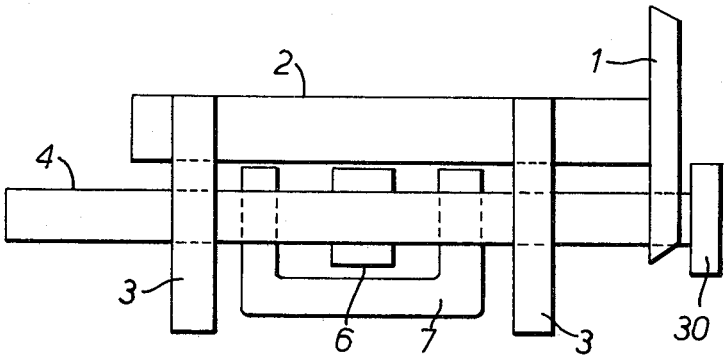
Figure 2:
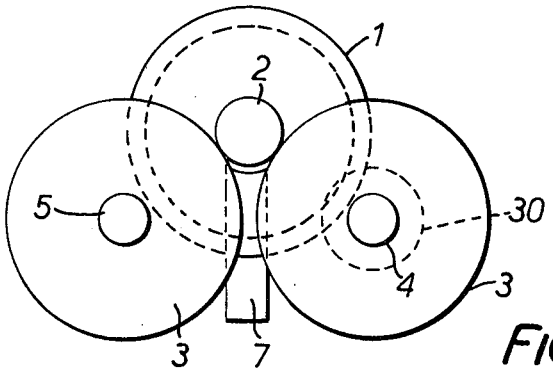
Figure 3:
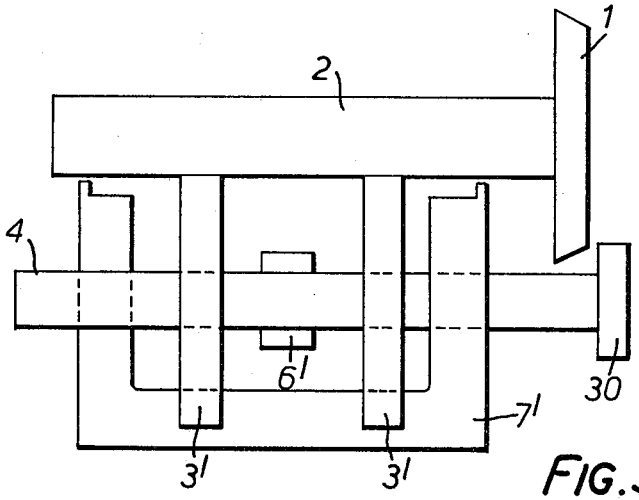
Figure 4:
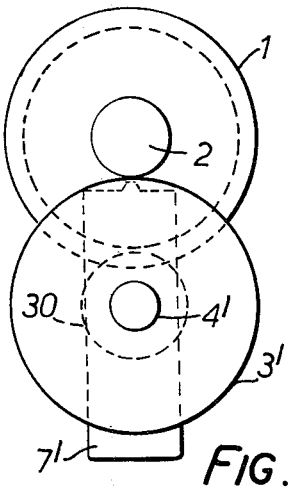
Figure 7:
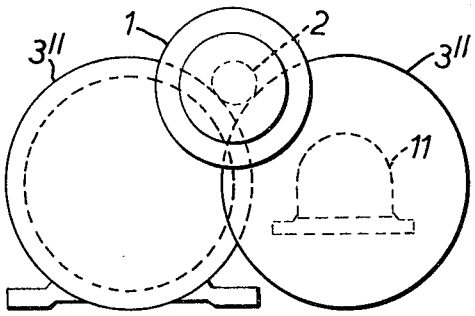
Figure 5:
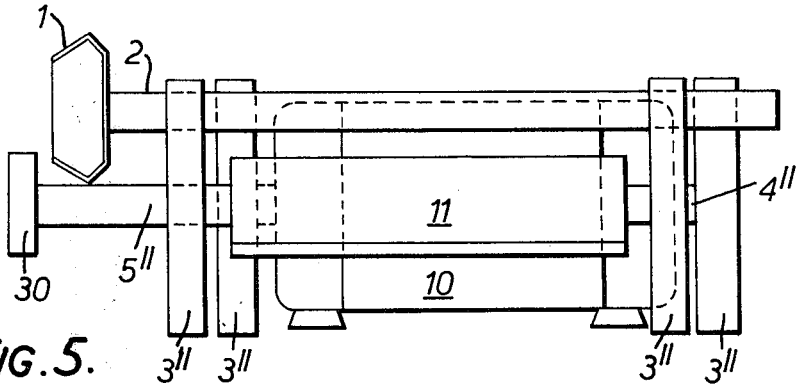
Figure 6:
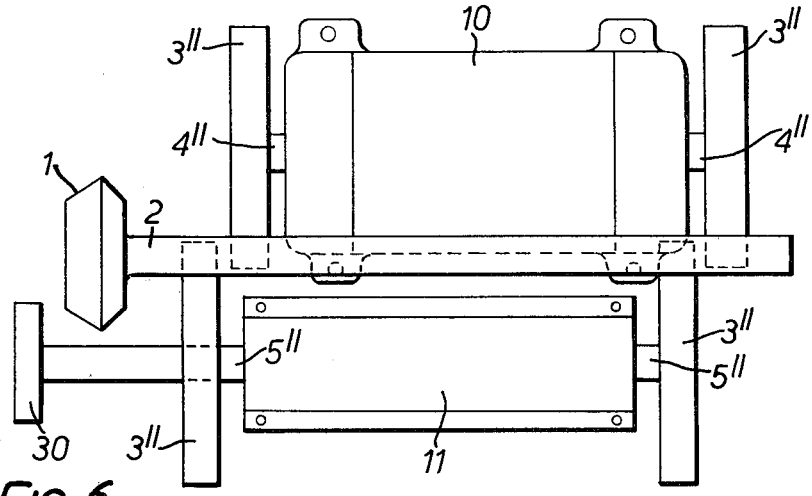
Figure 9:
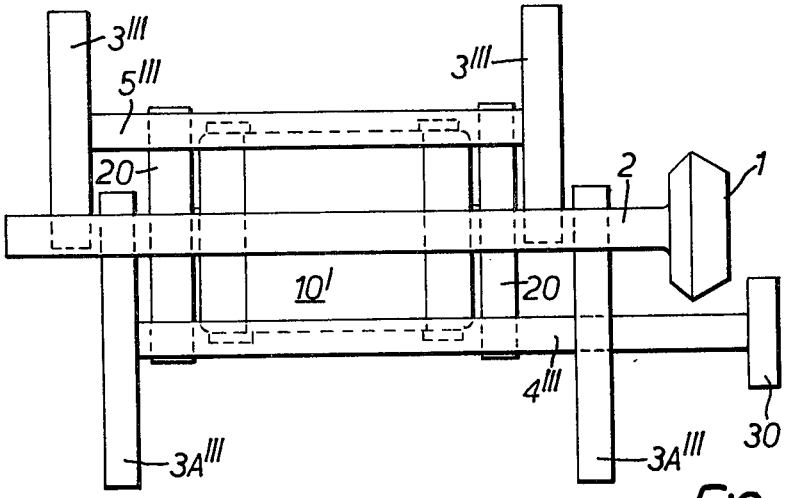
Figure 10:
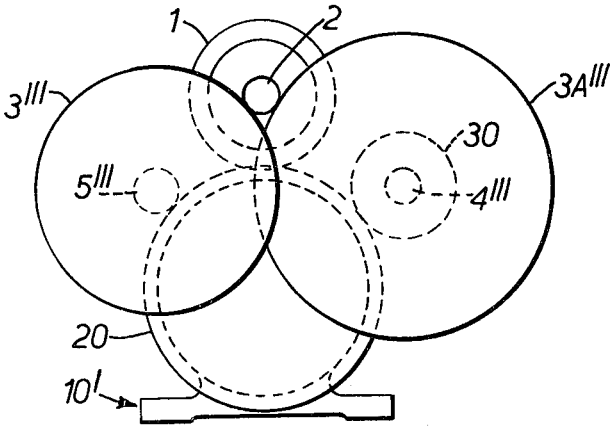
Figure 11:
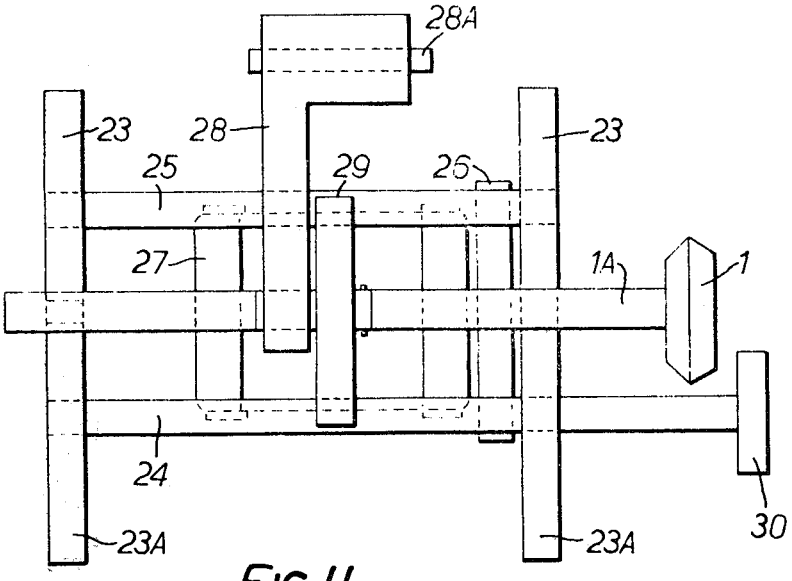

For a better understanding of the invention and to show how the same may be carried into effect reference will now be made, by way of example, to the accompanying drawings, in which:

FIG. 1 is a diagrammatic side view of part of a first form of open end yarn spinning apparatus, FIG. 2 is an end view of the apparatus of FIG. 1, FIG. 3 is a view similar to FIG. 1 of a second form of apparatus, FIGS. 5, 6 and 7 are respectively side, plan and end diagrammatic views illustrating a particular form of drive for apparatus such as shown in FIGS. 1 to 4, FIGS. 8, 9 and 10 are respectively side, plan and end diagrammatic views illustrating another form of drive, and FIG. 11 is a plan view of yet another form of drive.

Referring first to FIGS. 1 and 2, the member 1 that includes the collecting surface (not shown) that, in operation, is rotated at very high speed (in the region of 100,000 r.p.m.) while having deposited on it the fibers to be spun into yarn has its shaft 2 rotationally supported on two pairs of rollers 3, one roller of each pair being mounted on a first common shaft 4 and the other roller of each pair being mounted on a second common shaft 5. These shafts are supported, between the rollers of the two pairs, in ball bearings 6.

In the form shown the shaft 2 is maintained in contact with the rollers 3 by the magnetic field provided by a magnet 7. This magnet can be either a permanent magnet or an electromagnet. As clearly shown in the Figures, the diameter of the rollers 3 is substantially greater than that of the shaft 2 (for example of the order of four times greater). As a result, the speed at which the shafts 4 run in their supporting ball bearings 6 are within acceptable limits for such bearings when the shaft 2 is running at very high speeds, higher than are acceptable for such bearings. Drive is imparted to the shaft 2 from one or both of the rollers 3 of each pair by suitably driving one or both roller shafts 4, 5 as described hereinafter.

In the form of FIGS. 3 and 4, the member 1 and its shaft 2 are as described above. In this form, however, the shaft 2 is supported on two in-line rollers 3' only, mounted on a common shaft 4' running in a ball bearing 6' between the rollers 3'. A magnet 7' serves, in this form, the same function as the magnet 7 described above, and also serves to prevent the shaft 2 from moving tangentially of the rollers 3'. The magnet 7' can, of course, be either a permanent magnet or an electromagnet.

One manner of driving the shaft 2 in each of the forms of apparatus described above is illustrated in FIGS. 5, 6 and 7. In the apparatus as shown in FIGS. 5, 6 and 7, the shaft 2 carrying the member 1 is maintained in contact with two pairs of rollers 3'' by a magnetic field in any of the ways described above, the means providing this field being omitted from these three Figures. One roller of each pair is mounted on a first common shaft 4'' and the other roller of each pair is mounted on a second common shaft 5''. The first common shaft 4'' is the shaft of an armature of an electric motor 10 so that by running the motor 10 drive is imparted to the rollers 3'' carried by the shaft 4'', and hence to the shaft 2. The shaft 5'' is supported in a bearing block 11.

In an alternative form, not shown, the shaft 2 is the shaft of an armature of an electric motor.

Utilizing an electric motor drive as just described each shaft 2 of a spinning machine is driven independently, and automatic starting and stopping of each spinning unit, normally actuated by an electric stop motion, is greatly facilitated. However, in the constructions as so far described it is necessary for the electric motor to run at quite high speeds, of the order of 10,000–15,000 r.p.m. In order to run an electric motor at this speed it is necessary to provide high frequency A.C. With normal current supplied from power lines, (50 or 60 cycles per second), the maximum speed for an A.C. motor is 3,000 r.p.m. It is therefore necessary to provide a frequency divider to convert the normal current into a high frequency supply.

Figure 8:
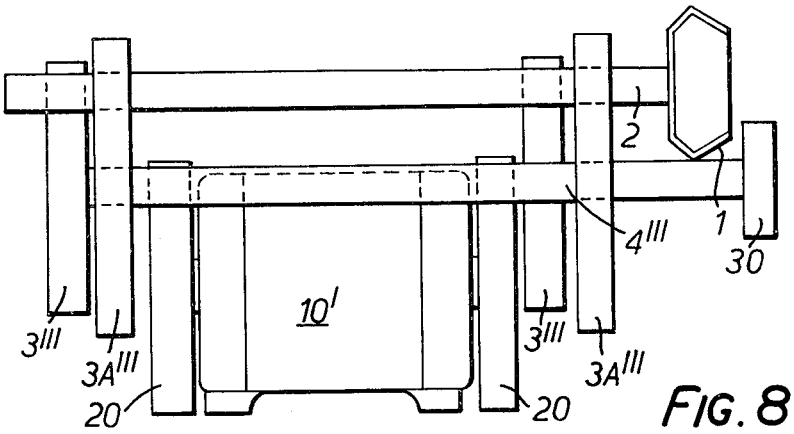

A further manner of driving the shaft 2 utilizing standard electric motor running at about 3,000 r.p.m. but without making use of a frequency divider is illustrated in FIGS. 8, 9 and 10.

In the apparatus of FIGS. 8, 9 and 10, the shaft 2 carrying the member 1 is again maintained in contact with two pairs of rollers, referenced in these Figures as 3''', 3''' and 3A''', 3A''', by a magnetic field in any of the ways described above, the means providing this field being omitted from FIGS. 8, 9 and 10. The pairs of rollers 3A''' are mounted on a first common shaft 4''' and the pair of rollers 3''' is mounted on a second common shaft 5''. The shaft 5''' is drivingly engaged with drive wheels 20 driven by the standard electric motor 10', but, for reasons that will be explained later, the shaft 4''' is not in contact with the drive wheels 20 (so that the shaft 5''' serves to drive the shaft 4''' via the shaft 2). Rollers 3A''' may have a different diameter than the rollers 3'''. The wheels 20 are of large diameter relative to the diameter of the shaft 5''' such that with the motor running to drive the wheels 20 at the order of 3,000 r.p.m., the shaft 5''' is rotated at the order of 15,000 r.p.m. The diameter of the rollers 3''' relative to the shaft 2 is substantially greater and such that the member 1 is consequently rotated at a speed of 50,000 – 100,000 r.p.m., depending on the particular diameters selected in any particular embodiment. Thus, the roller/shaft transmission considerably steps-up the rotational speed of the motor, which can be run a normal power supply (50 or 60 cycles per second), there being no need to provide a frequency divider. The motor can be a synchronous or an induction motor.

Finally FIG. 11 shows the rotor 1 of the apparatus of this Figure having its shaft 1A supported on two pairs of rollers 23 and 23A, the rollers 23A being mounted on a first common shaft 24 and the roller 23 being mounted on a second common shaft 25. The shaft 25 is drivingly engaged with a drive wheel 26 driven by an electric motor 27, the shaft 24 not being in contact with this drive wheel so that the shaft 25 serves to drive the shaft 24 via the shaft 1A. The wheel 26 is of large diameter relative to the diameter of the shaft 25 such that with the motor running to drive the wheel 26 at the order of 3,000 r.p.m., the shaft 25 is rotated at the order of 15,000 r.p.m. The diameter of the roller 23 relative to the shaft 1A is substantially greater and such that the rotor 1 is consequently rotated at a speed of 50,000 to 100,000 r.p.m., depending on the particular diameters selected in any particular embodiment. In this form, the magnetic field described above is not provided and instead there is a spring loaded arm 28 pivoting about a pin 28A and carrying a further roller 29 to bear on the shaft 1A to hold it in engagement with the pairs of rollers 23 and 23A. It will be appreciated that more than one such further roller could be provided, and that resilient means other than a spring could be utilized.

In each of the forms of apparatus described there is also provided an opening device only the opening roller 30 of which is shown in FIG. 11. In each case, this opening roller 30 is mounted on the shaft of one of the pairs of rollers supporting the member 1 and its shaft. Thus, in each case, the opening roller 30 is rotated at the speed of rotation of the supporting roller so that, in practice, if the shaft 2 (or shaft 1A) is rotated at a speed of the order of 50,000 r.p.m. the opening roller 30 will be rotated at between 6,000 and 12,000 r.p.m. A particularly suitable speed for example is of the order of 8,000 r.p.m., and this can be achieved by suitable selection of the diameters of the various supporting rollers and shafts involved. In such a case, and referring to FIGS. 8 to 10 in particular, the diameter of the rollers, 3A''', which would be larger than that of the rollers 3''', would be chosen to give the desired rotational speed to the opening roller 30 which would be less than that at which the shaft 2 rotates but greater than that at which the motor runs.

It will be appreciated that by mounting the opening roller 30 in the manner described no separate drive therefore is required and no additional bearings are necessary as the opening roller 30 is mounted fast with one of the shafts included in the support for the shaft 2.

I claim:

1. An open end yarn spinning apparatus comprising a member having a collecting surface that, in operation, is adapted to be rotated while having deposited thereon fibers to be spun into yarn, said member including a first shaft, two pairs of rollers engaging and supporting said first shaft at portions of the latter, said rollers being of substantially greater diameter than the diameter of the portions of the first shaft engaged thereby, second and third shafts, one roller of each said pair being mounted on said second shaft and the other roller of each said pair being mounted on said third shaft; an opening roller mounted on one of said second and third shafts to rotate therewith; and an electric motor, said third shaft is drivingly engaged with said electric motor to be driven thereby to drive said second shaft via the rollers mounted on said third shaft, the first shaft and the rollers mounted on the second shaft.

* * * * *